US005762554A

United States Patent [19]

Siu

[11] Patent Number: 5,762,554

[45] Date of Patent: Jun. 9, 1998

[54] CLOSED-LOOP STEERING CONTROL MECHANISM

[75] Inventor: Wai-Hung Siu, Kowloon, Hong Kong

[73] Assignee: Penta Blesses Enterprises Limited, Hong Kong, Hong Kong

[21] Appl. No.: 702,059

[22] Filed: Aug. 23, 1996

[51] Int. Cl.[6] ..... A63H 30/00

[52] U.S. Cl. ..... 463/37; 318/581

[58] Field of Search ..... 463/37, 38, 39, 463/6, 36, 63; 364/807, 828; 244/189, 190; 434/62, 63, 71; 701/21; 318/580, 581

[56] References Cited

U.S. PATENT DOCUMENTS 3,946,691 3/1976 Freeman ..... 364/828

4,817,948 4/1989 Simonelli ..... 463/6

5,107,424 4/1992 Bird et al. ..... 701/21

*Primary Examiner*—George Manuel

*Attorney, Agent, or Firm*—Burns, Doane, Swecker & Mathis, L.L.P.

[57] ABSTRACT

A simple, low-cost but efficient closed-loop steering control mechanism for a remote-controlled toy which can be utilised to quickly steer a mobile toy to a plurality of pre-determined steering orientations by comparing feedback signals from the steering mechanism with a two-component reference signal which is unique for each specific steering position and is generated by a steering controller in response to instructions from a remote controller.

13 Claims, 10 Drawing Sheets

CLOSED-LOOP STEERING CONTROL MECHANISM

FIELD OF THE INVENTION

The present invention relates generally to an improved steering control mechanism for a remote-controlled toy, in particular, it relates to a steering control mechanism for producing quick and accurate steering by means of a relatively simple device especially suitable for a remote-controlled toy vehicle. It also relates to a circuit arrangement suitable for use in such an improvement.

BACKGROUND OF THE INVENTION

Remote-controlled toys, for example, radio-controlled motor vehicles or boats, which can be controlled to operate like real are companions to many young children which give them the opportunities to experience the pleasure and fun in independently controlling a motor vehicle at an early age. Apart from providing fun and pleasure, this type of toy is also valuable since it trains and improves the coordination of activities between the brain and fingers and at the same time improving their reflexive responsiveness.

Conventional remote-controlled toys having steering capabilities usually comprise a remote-controller which transmits control instructions to the receiver located on a mobile toy. The receiver then decodes the instructions to give controlling signals to effect actual control of the steering mechanism. While such a simple open-loop system provides a low-cost control mechanism, its repeatability is uncertain, especially when the steering has been misaligned. Closed-loop control systems which use a feedback control signal derived from a variable resistor which is connected to the steering mechanism have been employed to improve steering performance in higher cost toys. Such systems are usually slow in seeking the correct steering position and the variable resistor deteriorates rapidly due to prolonged contact friction. Servo-motors are sometimes used to provide quick and accurate steering control. However, such motors are expensive and are not widely used in lower-cost toys. It would be highly desirable if a simple and low-cost mechanism which would offer comparable steering performance were available.

SUMMARY OF THE INVENTION

According to the present invention, there is provided a closed-loop steering control mechanism for a remote-controlled toy comprising a steering controller, a steering mechanism and a position sensing device wherein said steering mechanism comprises movable parts which can cause the said toy to steer between first and second extreme steering positions, said steering controller comprises means for controlling said steering mechanism to steer to a plurality of pre-determined steering positions between the said first and second extreme steering positions in a response to a signal received from a remote controller, said position sensing device comprises a plurality of position identifying means corresponding to the said pre-determined steering positions, each said position identifying means is characterised by a unique position-identifying signal, said position sensing device further comprises means for selectively picking up the position identifying signal which corresponds to the instantaneous steering position, and said steering controller further comprises means for receiving said position identifying signal thereby determining the instantaneous steering position, comparison means for comparing said instantaneous steering position with a selected pre-determined steering position, and means for generating a steering output signal dependent on the result of said comparison.

Preferably the levels of the position-identifying signals are arranged in an incremental manner in which the highest and lowest signal levels correspond respectively to said first and second extreme positions.

Preferably upon receiving a control signal from said remote controller said steering controller generates a reference signal comprising first and second components defining respectively the upper and lower limits of the allowable level of said position-identifying signal corresponding to a specific steering position.

Preferably said position sensing device comprises a first part having a plurality of position identifying means and a second part which is movable in response to a steering action of said toy.

Preferably upon receiving a control signal from said remote controller said steering controller generates a reference signal comprising first and second components defining respectively the upper and lower limits of the allowable level of said position identifying signal corresponding to a specific steering position, and said steering controller comprises means for comparing said instantaneous position identifying signal with said reference signal such that when the level of said position identifying signal exceeds that of the first component of said reference signal, said steering controller will cause the steering mechanism to move towards the said second extreme steering position.

Preferably upon receiving a control signal from said remote controller said steering controller generates a reference signal comprising first and second components defining respectively the upper and lower limits of the allowable level of said position identifying signal corresponding to a specific steering position, and said steering controller comprises means for comparing said instantaneous position identifying signal with said reference signal such that when the level of said position identifying signal is below that of the second component of said reference signal, said steering controller will cause the steering mechanism to move towards the said first extreme steering position.

Preferably said steering controller comprises means for determining the instantaneous steering state of said steering mechanism and means for memorising the previous steering state.

According to the present invention, there is also provided a steering control mechanism for controlling a remote-controlled toy comprising a steering controller, a steering mechanism and a position sensing device wherein said steering mechanism can be controlled to steer in a plurality of pre-determined positions between first and second extreme steering position, said steering controller controls said steering mechanism to steer to a designated steering position, and said steering controller comprises means to damp the steering motion at the instant at which the steering mechanism transits from a non-designated steering position to a designated steering position. Preferably said steering controller further comprises means for determining the instantaneous steering state and the immediately preceding steering state.

Preferably said steering controller generates a short reversing pulse to the motor which controls the said steering mechanism at the said transition. Preferably said steering controller comprises a D-type flip-flop.

BRIEF DESCRIPTION OF THE DRAWINGS

A preferred embodiment of the present invention will now be explained by way of example and with reference to the accompanying drawings, in which.

DETAILED DESCRIPTIONS OF THE PREFERRED EMBODIMENTS

Figure 1:
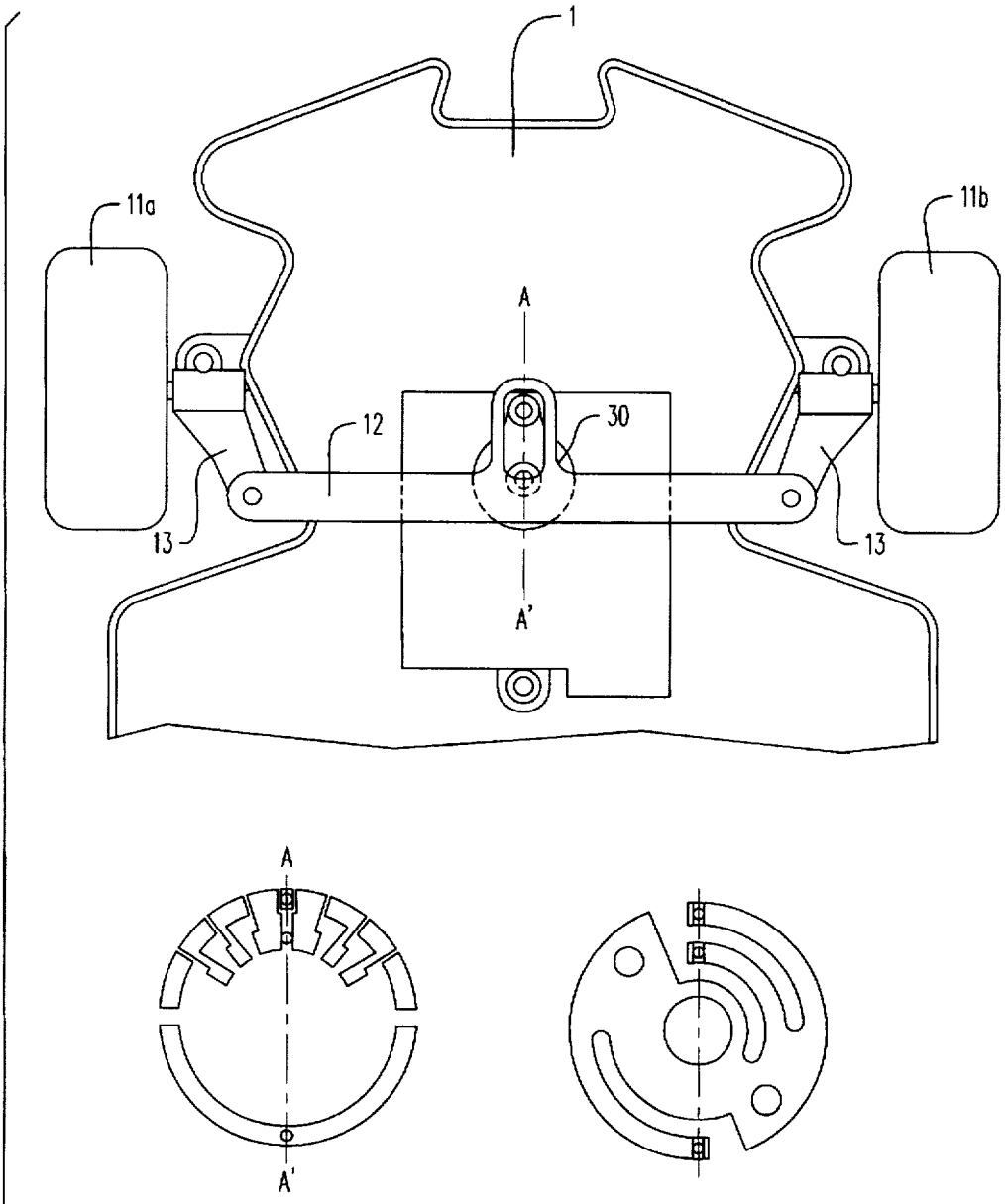
FIG. 1 shows the steering mechanism in the centrally steered position.
Figure 2:
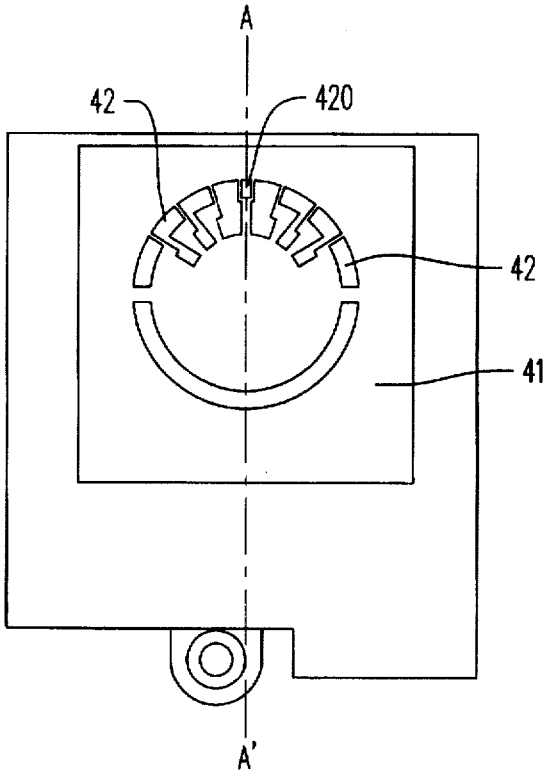
FIG. 2 shows a first part of the position sensing device which is biased with a plurality of position identifying signals corresponding to a plurality of pre-determined steering positions.
Figure 3:
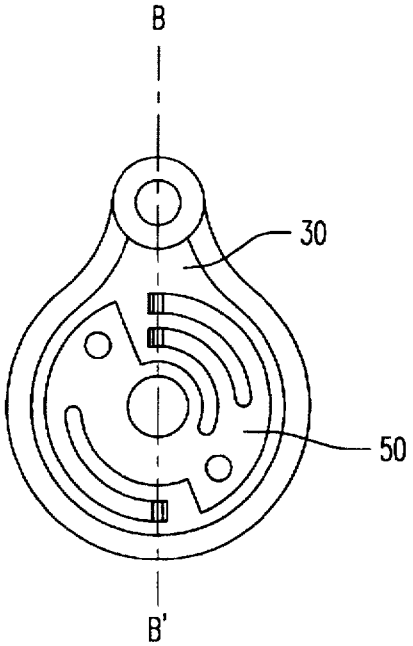
FIG. 3 shows a second part of the position sensing device which is movable relative to the first part of FIG. 2.
Figure 4:
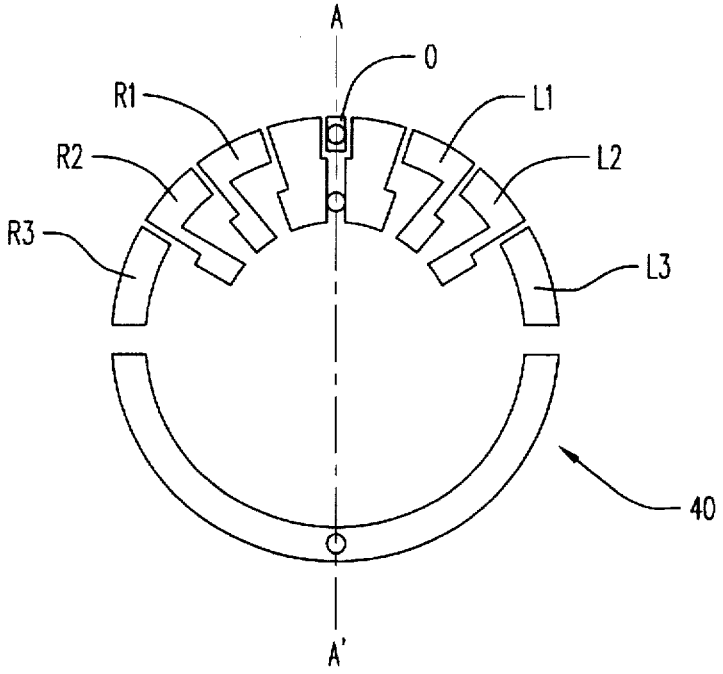
FIG. 4 shows the position identifying points on the first part of the sensing device of FIG. 2 which correspond to a plurality of pre-determined steering positions.

The steering part of a typical remote-controlled toy usually comprises a remote controller, a receiver front-end, a steering controller and a steering mechanism. The remote controller transmits control instructions which are to be received by a receiver front-end provided on the mobile toy to control steering. The control instructions received by the receiver are then converted into steering control signals which operate the steering controller to actually control the steering mechanism to reach the designated steering position.

The steering controller comprises a decoder, a decision maker and a position sensing device. The decoder transforms the received control instructions to produce steering control signals which can be used by the decision maker. The position sensing device is provided to detect the instantaneous steering state of the vehicle and to inform the decision maker of this instantaneous steering state for making control decisions.

Referring to FIG. 1 to 9, the sensing device comprises a first part 40 which is attached to the main vehicle chassis 1 and a second part 50 which is connected to a movable part of the steering mechanism. Preferably, this movable part is characterised by its displacements which are directly indicative of the amount of angular steering of the plane of the steering wheels 11*a* &*b*. In a conventional remote-controlled toy, actual steering is usually effected by lateral translations of a steering link 12 which controls the horizontal pivotal movement of a knuckle arm 13 connected to the axle of the steering wheels. The steering link 12 itself is usually driven into translational displacement by a rotary arm 30 which is reciprocally rotatable between two extreme steering positions (L3 & R3 in FIG. 9). The angular displacement of the rotary arm 13 usually correlates linearly with the actual steering angle and is therefore ideal for connecting to the second part of the sensing device. However, it shall be appreciated that the movement sensor could be attached to other movable parts, for example the steering link.

The first part of the position sensing device of the present embodiment comprises a printed circuit board 41 which is provided with a plurality of conductive positioning identifying points 42 each of which is biased with a unique identifying signal. These position identifying points are distributed on the upper surface of the printed circuit board 41 and are arranged in a circumferential manner corresponding to a plurality of pre-determined angular steering positions. Preferably the signal levels are arranged in a straight incremental or decremental manner such that one extreme steering position is biased with the highest signal level while the other extreme is biased with the lowest level. Preferably the positioning point 420 corresponding to centre steering position is biased with the average of these two extreme levels. In the embodiment shown there are seven steering positions, three left, three right and one straight. Obviously any number could be provided, but preferably it should be symmetrical, i.e. of the form 2N+1 with a central straight position.

Figure 5:
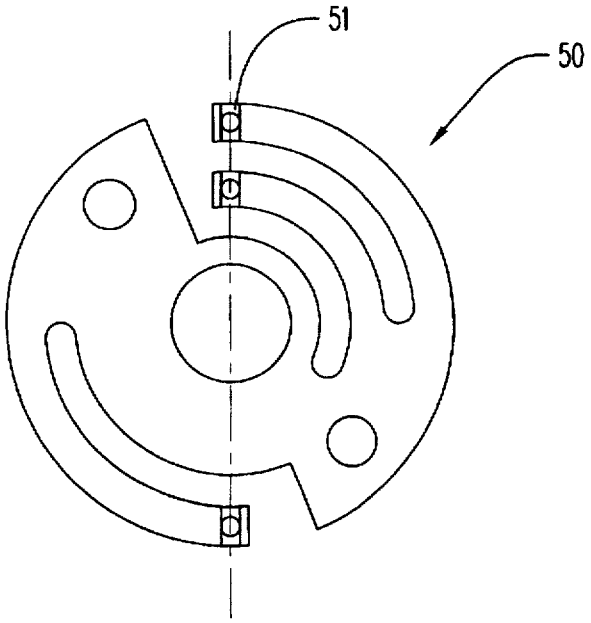
FIG. 5 shows the component of the device of FIG. 3 which is for picking up position identifying signals present on the device part of FIG. 2.
Figure 6:
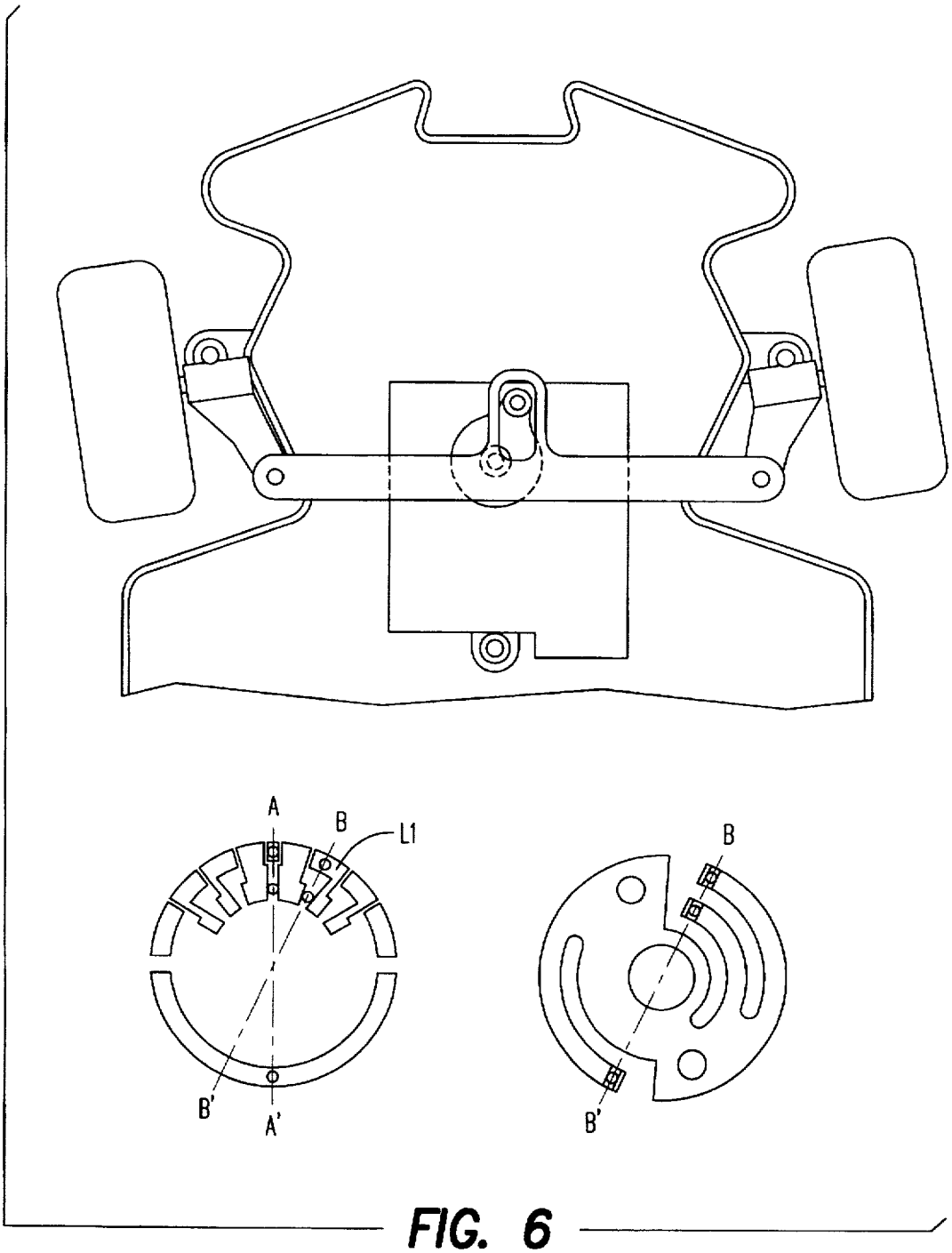
FIG. 6 illustrates the steering mechanism arrangement when it is steered to turn to the pre-determined position L1 of FIG. 4 and also shows the relative positions of the first and second part of the position device in this steering mode.
Figure 7:
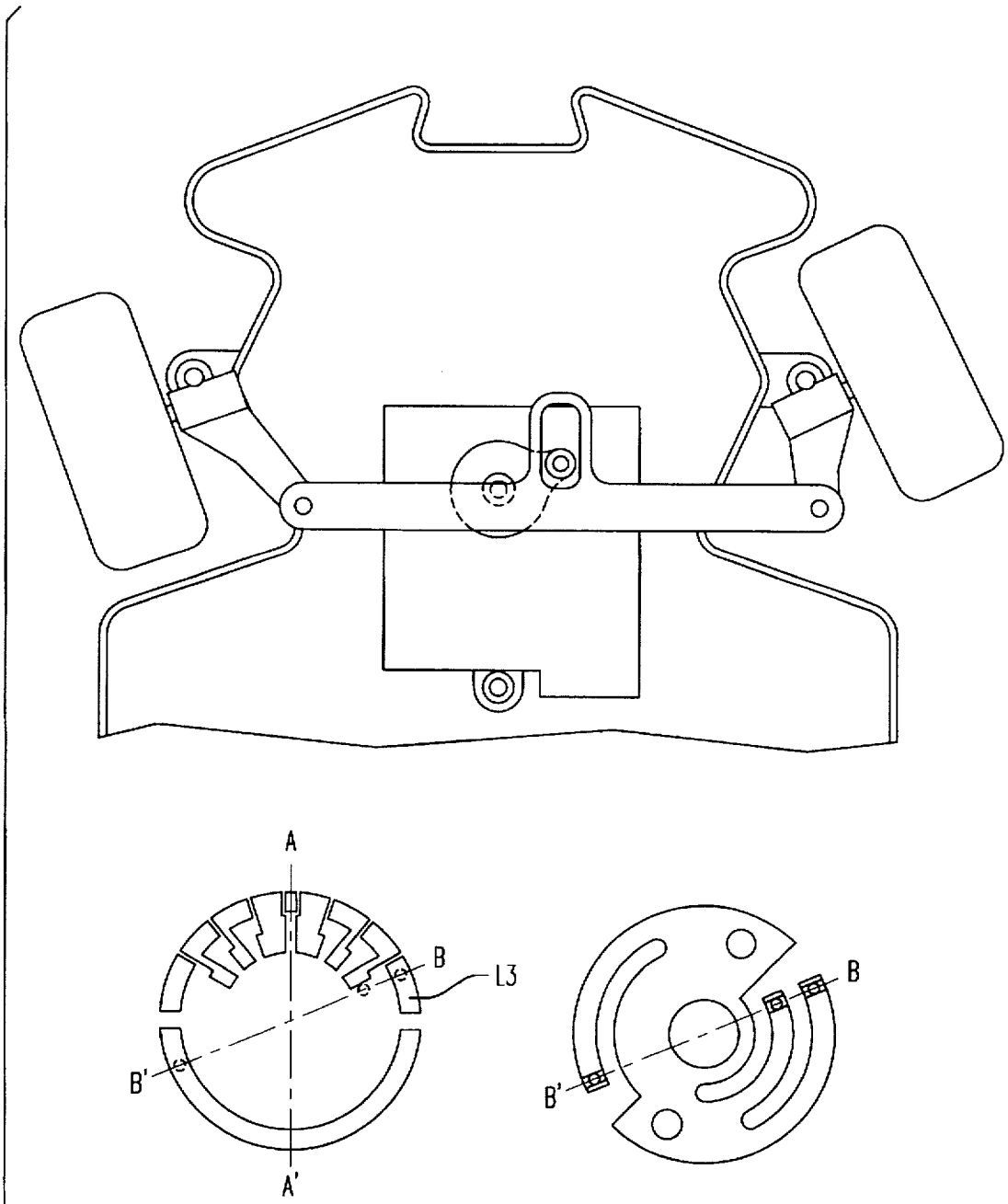
FIG. 7 illustrates the steering mechanism arrangement when it is steered to turn to the pre-determined position L3 of FIG. 4 and also shows the relative positions of the first and second part of the position device in this steering mode.
Figure 8:
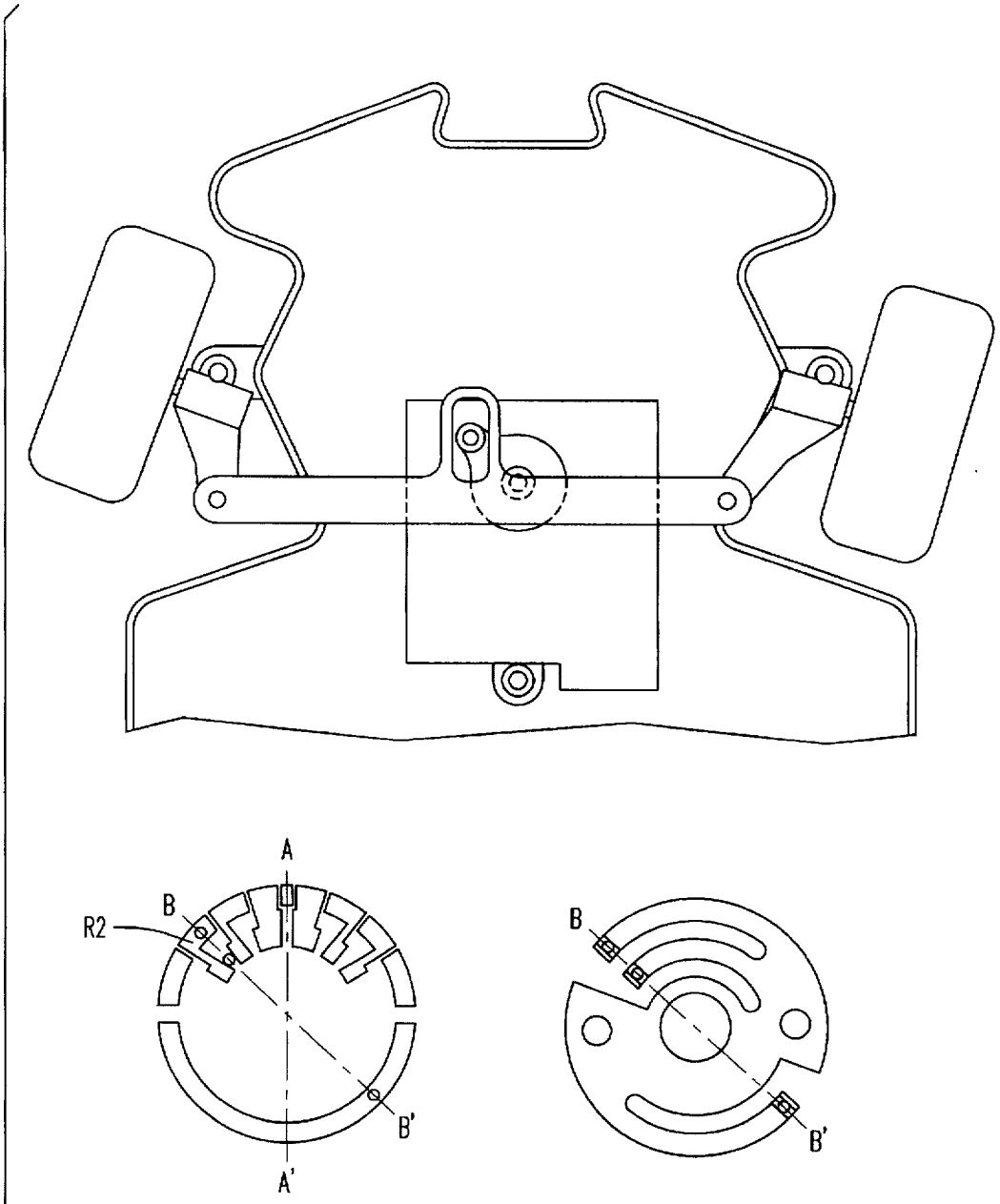
FIG. 8 illustrates the steering mechanism arrangement when it is steered to turn to the pre-determined position R3 of FIG. 4 and also shows the relative positions of the first and second part of the position device in this steering mode.
Figure 9:
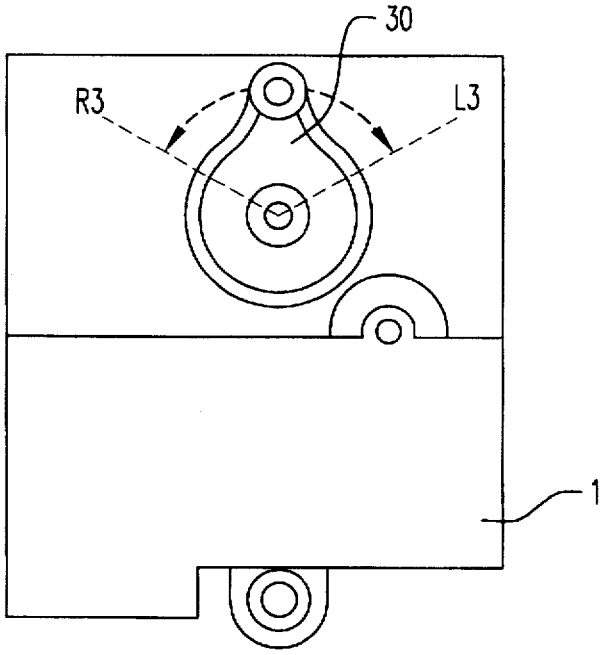
FIG. 9 shows a main chassis connected with a rotary arm which is rotatable between the two positions L3 and R3.

The second part 50 shown in FIG. 5 is a conductive plate which is attached to the underside of the rotary arm 30 and is provided with a spring contact 51. The first and second parts of the sensing device are combined to form a rotary switch in which the spring contact 51 can make sequential contacts with the position identifying points as a result of the rotary arm movements. When the spring contact makes a selective contact with a specific positioning point, the biasing signal thereon will be picked up and relayed through the spring contact to the decision maker. Since each biasing signal has a specific identification value, the decision maker can determine from the received signal the instantaneous steering state.

The amount of angular steering is controlled by the remote controller which transmits instructions regarding the designated position to the receiver. The instructions which are received by the receiver will be decoded to produce steering control signals to control the steering mechanism. The control signals comprise a set of pre-determined signals each of which represent a specific pre-determined steering position. Each of these control signals comprises a first and a second component which define the maximum and minimum levels within which the feedback signal appearing at the decision maker and corresponding to that specific steering position must be set.

As mentioned above, the positioning points in the sensing device are biased in a monotonous incremental or decremental manner so that each biasing level represent a specific steering position. Preferably, the set of control signals are also arranged in a similar manner with the same variation profile and in a correlating way, thus resulting in an one-to-one matching relationship between the control signals and the feedback signals which are derived from the position sensing device.

The general operating principle of the decision maker is such that when the feedback signal level received falls within the signal level range defined by the steering control signal, the steering mechanism is properly positioned as intended. If the feedback signal falls outside that signal range, the steering controller operates to control the steering mechanism to move to the next angular positions until the feedback signal falls within that range. As mentioned above, the biasing signals are preferably arranged in a monotonously incremental or decremental manner consistent with that of the set of the control signals.

If the feedback signal level exceeds the maximum component of the control level, the steering controller will operate to steer the steering mechanism to move to the next steering position which will give a lower feedback signal level, i.e. by moving towards the extreme steering position corresponding to the lowest feedback signal level.

Conversely, if the feedback signal level is below the minimum component of the control level, the steering controller will operate the steering mechanism to move to the next steering position which will give a higher feedback signal level, i.e. by moving towards the extreme steering position corresponding to the highest feedback signal level.

Figure 10:
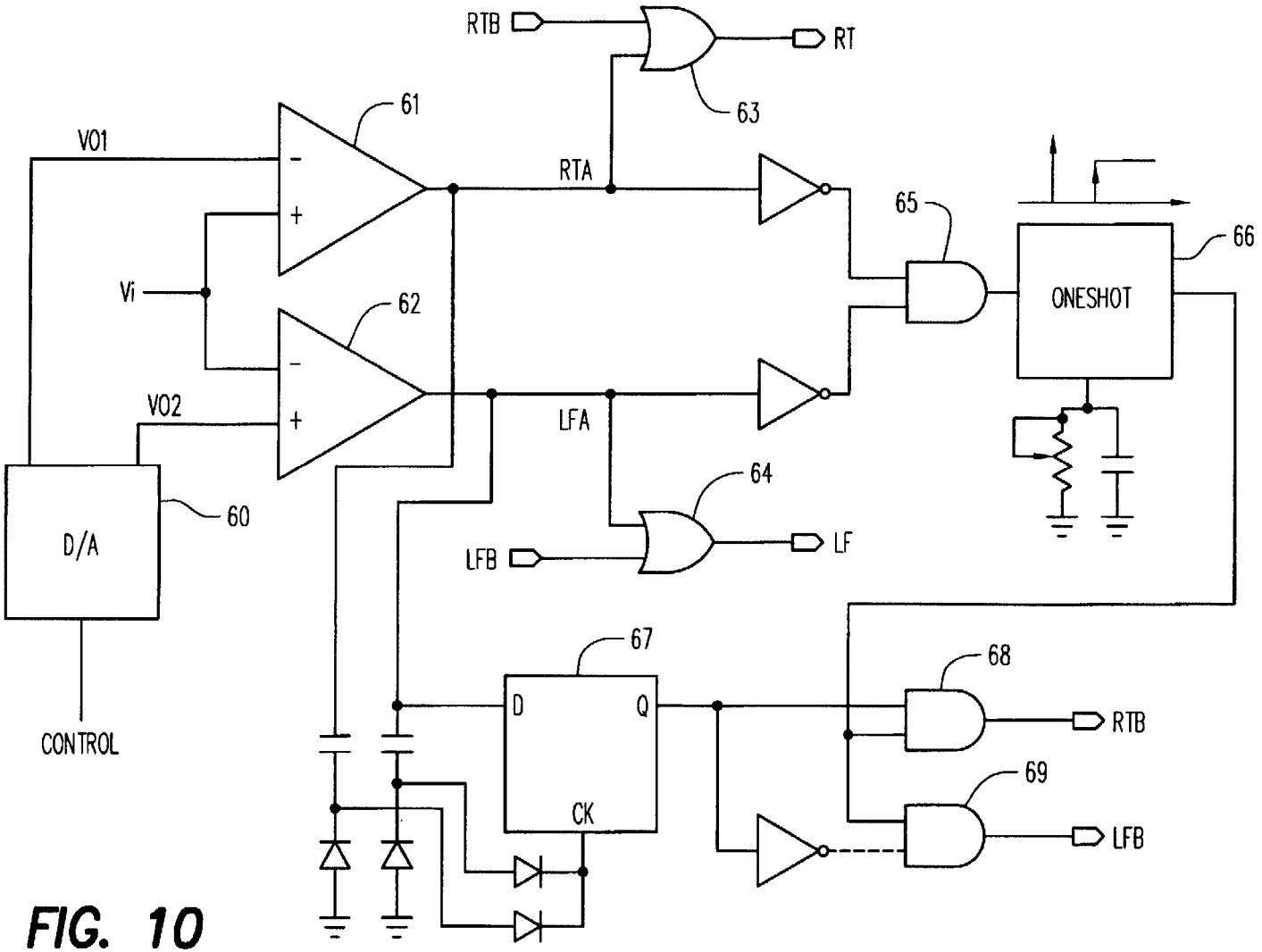
FIG. 10 shows a schematic circuit arrangement suitable for use in a decision maker for the present control mechanism.

Referring to FIG. 10, there is shown an example circuit embodiment which can be used as a decision making circuit. The circuit comprises a decoder 60, for example by using a digital-to-analogue converter integrated circuit, which converts control instructions received from the transmitter to produce a steering control signal. This steering signal is split into a higher first Vo1 and a lower second Vo2 component by means for example of a resistor bridge. The first and second components are then compared at a comparator pair 61 and 62 with the feedback signal Vi which is received from the sensing device. The higher level component Vo1 is fed to the negative input of the first comparator 61 and the lower level signal component Vo2 is fed to the positive input of the second comparator 62.

For sake of convenience, the operation of this circuitry will now be explained with reference to FIGS. 11 & 12 which provide an arbitrary set of example steering positions and their corresponding signal levels. The signal sets are provided for a control scheme having a centre steering position and three steering steps both to the first (L) and the second (R) steering extremes. The set of feedback signals is set arbitrarily for present illustrative purposes in the manner that the feedback signal level is maximum when the steering mechanism is positioned at the first extreme position (L) and minimum when the steering is at the second extreme position (R).

Referring to a first situation in which the current steering position (P1) is between the first extreme position (L) and the designated steering position (Pd), the instantaneous steering position is too much towards the first extreme position (L) and needs to be steered towards the second extreme position (R). Under this circumstance, the instantaneous feedback signal level Vi exceeds Vo1, the upper limit of the steering control signal of the designated position, and the first comparator output will be high, causing the "OR" gate (63) output to be high and setting the "R" flag high which will cause the steering mechanism to steer towards R. At this instance, since Vo1 is more positive than Vo2, the second comparator output will be low.

In the second situation in which the instantaneous steering position (P2) is between the second extreme position (R) and the designated position (Pd), the instantaneous steering position is too much towards the second extreme position (R) and needs to be steered towards the first extreme position (L). Under this circumstance, the feedback signal level Vi is below Vo2, the lower limit of the steering control signal corresponding to the designated position, and the first comparator output will be high, causing the "OR" gate (64) output to be high and setting the "L" flag high which will cause the steering mechanism to turn towards L. At this instance, the first comparator output will be low.

In the third situation in which the instantaneous steering position (P3) overlaps with designated position (Pd), the level of Vi is intermediate between Vo1 and Vo2. Under this circumstances, the steering mechanism has reached the correct position and both "OR" gates 63 & 64 will have low output, i.e. there is no more steering signal, unless one of the second input (RtA or LfA) is pulled high. Since Vo1 is always set to be more positive than Vo2, it should be noted that the comparator outputs would not be both high at the same time due to the inputs.

To alleviate delay caused due to over-steering or steering overshoot when the steering mechanism moves rapidly from other positions to the designated position, it would be advantageous to halt the steering motor as soon as the steering mechanism has reached the designated position. This can be achieved by sending a stop signal to the motor controller at a suitable instant. In reality, a bi-directional motor is usually controlled by a differential bridge and the motor can simply be halted by sending pulsed current in the reverse direction in response to a stop signal.

Referring to FIG. 10, a stop signal is generated by a damping circuit which comprises a state circuit 66 and a delay circuit 67. The input of the state circuit 66 is connected to the inverted outputs of the comparators 61 & 62 through an "AND" gate 65. This input will be high only when both comparator outputs are simultaneously low, that is corresponding to the state where the instantaneous steering position (Pi) coincides with the designated position (Pd). When the input is high, the state circuit will generate an enable signal which is a pulse of a suitable width.

To ensure that a damping signal is only generated in response to a transition of the steering mechanism from a non-designated position into the designated position, two pre-conditions must be met. The first condition is that the instantaneous steering position is the designated position and the second cumulative condition is that the steering mechanism must have been previously positioned at a non-designated position. This requirement is tested by monitoring the changes which occur at the comparator outputs 61 & 62 and by means of a delay circuit which comprises a D-type flip-flop 67 for triggering on this transition. Since whenever there is a high-to-low transition occurring at either comparator outputs 61 & 62, it is a indication that the steering mechanism has entered into the designated position from some non-designated position. For monitoring this high-to-low transition, a D-type flip-flop which triggers on a falling clock edge is suitable. Obviously, if, in an alternative circuit arrangement, this transition is characterised by a low-to-high transition, a rising clock edge triggered D-flip-flop should be used instead.

When the second comparator output 62 changes from high to low, it indicates that the steering mechanism has moved into the designated position (Pd) from a non-designated position corresponding to the second situation above, i.e. moving away from the second extreme R towards the first extreme (L) in order to reach the designated position (Pd). This high-low transition occurs at the instant when the steering mechanism has just arrived at the designated position Pd from its original position P2.

Because of the floating nature of the comparator output and because of capacitive elements at the output, this high-low transition will take place at the D flip-flop input according to the input circuit time constant. Since the comparator output 62 is also connected to the clock input of the D flip-flop, the high comparator output previously present at the flip-flop input will be transferred to the flip-flop output with a slight time-constant delay and only on a high-to-low transition. Since the flip-flop output is fed to the "AND" gate 68 input together with the pulsed enable signal generated by the state circuit, the "AND" gate 68 will produce a pulsed stop signal at the "OR" gate 63 which will halt further steering by sending a short reversing pulse to the motor controller to cause it to steer towards the opposite side, i.e. R for a short period.

The only other possible high-low transition that could exist at the comparator pair 61 & 62 is the first situation above where the previous steering position was between the first extreme position (L) and the designated steering position (Pd). As explained above, under normal operating conditions, the comparator output pair always have opposite outputs except in the third situation above where the steering has reached the designated position Pd. Referring to FIG. 6 again, the clock input to the D flip-flop is connected in a parallel manner to the output of the first comparator 61 and with a similar input circuit. On the high-low transition of the comparator output 61, the low signal level previously present at the D-input will be transferred to the flip-flop output with the time constant delay. Under this condition, both the enable signal and the inverted flip-flop output will cause a high output at the "AND" gate 69 to produce a stop signal pulse at the "OR" gate 64 which will halt further steering by instructing the motor to steer towards the opposite side, i.e. L for a short period.

Figure 11:
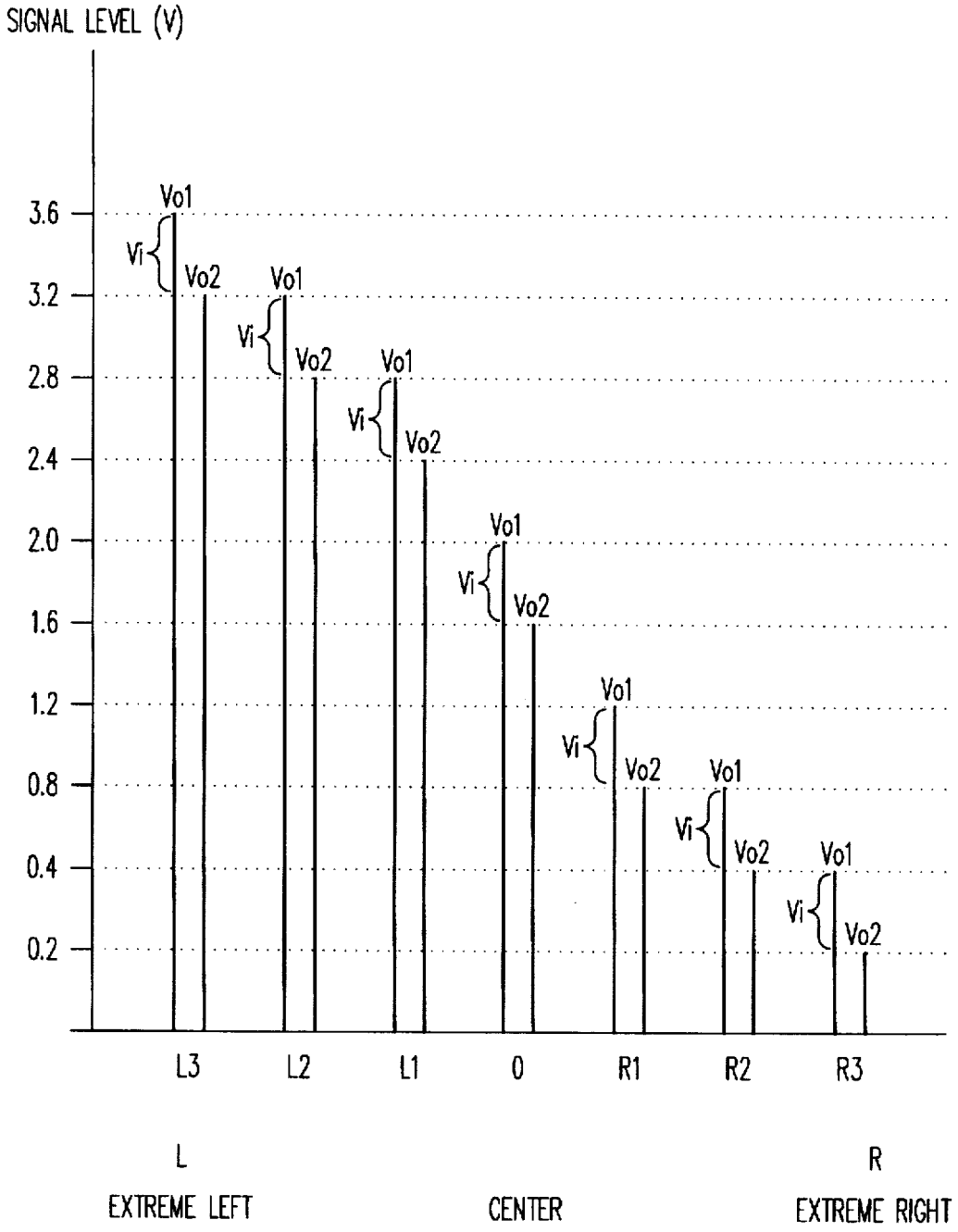
FIG. 11 shows an example of signal level arrangements for a sensing device having three pre-determined positions both to the left and to the right, plus a centre position.
Figure 12:
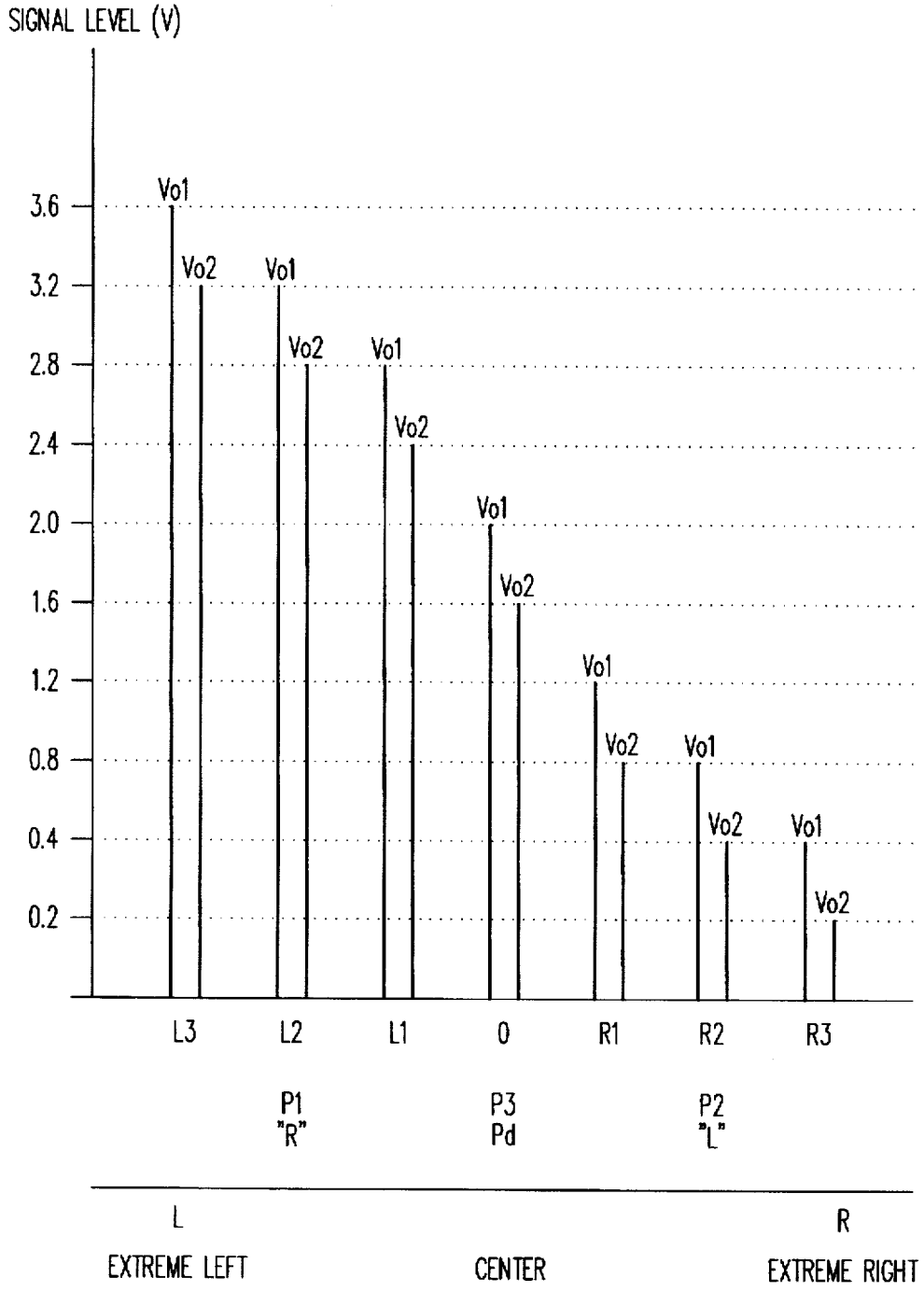
FIG. 12 is a schematic diagram showing the operation of the decision maker according to various situations.

Referring to the examples in FIGS. 11 & 12 where the steering positions are labelled L3, . . . . 0, . . . . , R3 corresponding to the 7 pre-determined positions in which L3 and R3 represent respectively the first and second extreme steering positions. The set of steering control signals provided in FIG. 11 are set arbitrarily for illustration purposes in which, for example, the first Vo1 and second Vo2 components of the control signal for the position L1 are respectively set at 2.8 V and 2.4 V and the corresponding feedback signal for this position should be between these two levels, say 2.6V, the average value for convenience. If the chosen designated position is L1 and the instantaneous position is L2, the instantaneous feedback signal corresponding to L2 is, for example, 3V. This will cause a low output at the first comparator 61 and high output at the second comparator 62, causing the steering mechanism to move towards R3 (R). When the steering mechanism reaches L1, the feedback signal Vi corresponding to this position is 2.6 V. This will result in low outputs at both comparator output 61 & 62 indicating the designated position and activating the state circuit 66 to generate a enable pulse signal. At this instant, the high to low transition of the second comparator will trigger the clock of the D flip-flop and cause the high state still present at the flip-flop input to be transported to its output and at the same time sending a reversing or stop pulse to the motor controller, thereby completing a steering control cycle.

While the present embodiment has been explained with reference to a toy vehicle, it should be appreciated that such a mechanism can also be employed generally in other remote-controlled mobile toys such as boats, projectiles or robots.

I claim:

1. A closed-loop steering control mechanism for a remote-controlled toy comprising a steering controller, a steering mechanism and a position sensing device wherein:

said steering mechanism comprises movable parts which can cause the said toy to steer between first and second extreme steering positions, said steering controller comprises means for controlling said steering mechanism to steer to a plurality of pre-determined steering positions between the said first and second extreme steering positions in a response to a signal received from a remote controller, said position sensing device comprises a plurality of position identifying means corresponding to the said pre-determined steering positions, each said position identifying means is characterised by a unique position-identifying signal, said position sensing device further comprises means for selectively picking up the position identifying signal which corresponds to the instantaneous steering position, and said steering controller further comprises means for receiving said position identifying signal, thereby determining the instantaneous steering position, comparison means for comparing said instantaneous steering position with a selected pre-determined steering position, and means for generating a steering output signal dependent on the result of said comparison.

2. A steering mechanism according to claim 1 wherein:

the levels of the position-identifying signals are arranged in an incremental manner in which the highest and lowest signal levels correspond respectively to said first and second extreme positions.

3. A steering mechanism according to claim 2 wherein upon receiving a control signal from said remote controller said steering controller generates a reference signal comprising first and second components defining respectively the upper and lower limits of the allowable level of said position identifying signal corresponding to a specific steering position, and said steering controller comprises means for comparing said instantaneous position identifying signal with said reference signal such that when the level of said position identifying signal exceeds that of the first component of said reference signal, said steering controller will cause the steering mechanism to move towards the said second extreme steering position.

4. A steering mechanism according to claim 2 wherein upon receiving a control signal from said remote controller said steering controller generates a reference signal comprising first and second components defining respectively the upper and lower limits of the allowable level of said position identifying signal corresponding to a specific steering position, and said steering controller comprises means for comparing said instantaneous position identifying signal with said reference signal such that when the level of said position identifying signal is below that of the second component of said reference signal, said steering controller will cause the steering mechanism to move towards the said first extreme steering position.

5. A steering mechanism according to claim 1 wherein, upon receiving a control signal from said remote controller said steering controller generates a reference signal comprising first and second components defining respectively the upper and lower limits of the allowable level of said position-identifying signal corresponding to a specific steering position.

6. A steering mechanism according to claim 5 wherein:

said steering controller comprises first and second comparator circuits each of which receives said instantaneous position identifying signal as an input and in which the said first component of said reference signal is connected to the negative input of said first comparator, and said second component of said reference signal is connected to the positive input of said second comparator.

7. A steering mechanism according to claim 1 wherein:

said position sensing device comprises a first part having a plurality of position identifying means and a second part which is movable in response to a steering action of said toy.

8. A control mechanism according to claim 1 wherein:

said steering controller comprises means for determining the instantaneous steering state of said steering mechanism and means for memorising the previous steering state.

9. A steering control mechanism for controlling a remote-controlled toy comprising a steering controller, a steering mechanism and a position sensing device wherein:

said steering mechanism can be controlled to steer in a plurality of pre-determined positions between first and second extreme steering position, said steering controller controls said steering mechanism to steer to a designated steering position, and said steering controller comprises means to damp the steering motion at the instant at which the steering mechanism transits from a non-designated steering position to a designated steering position.

10. A control mechanism according to claim 9 wherein:

said steering controller further comprises means for determining the instantaneous steering state and the immediately preceding steering state.

11. A control mechanism according to claim 9 wherein:

said steering controller generates a short reversing pulse to the motor which controls the said steering mechanism at the said transition.

12. A control mechanism according to claim 9 wherein:

said steering controller comprises a D-type flip-flop.

13. A control mechanism according to claim 12 wherein:

said flip-flop triggers on a falling clock edge corresponding to said transitional instant.

* * * * *